US009562505B2

(12) United States Patent
Hokkanen et al.

(10) Patent No.: US 9,562,505 B2
(45) Date of Patent: Feb. 7, 2017

(54) SYSTEM AND METHOD FOR CONTROL OF FUEL INJECTOR SPRAY

(71) Applicant: CUMMINS INC., Columbus, IN (US)

(72) Inventors: Vesa Hokkanen, Columbus, IN (US); David L. Buchanan, Westport, IN (US); Lester L. Peters, Columbus, IN (US); Rajesh K. Garg, Columbus, IN (US)

(73) Assignee: Cummins Inc., Columbus, IN (US)

( * ) Notice: Subject to any disclaimer, the term of this patent is extended or adjusted under 35 U.S.C. 154(b) by 393 days.

(21) Appl. No.: 13/915,305

(22) Filed: Jun. 11, 2013

(65) Prior Publication Data

US 2014/0361096 A1 Dec. 11, 2014

(51) Int. Cl.

*F02M 63/02* (2006.01)
*F02M 45/08* (2006.01)
*F02M 51/06* (2006.01)

(52) U.S. Cl.

CPC ..... *F02M 63/029* (2013.01); *F02M 45/086* (2013.01); *F02M 51/0603* (2013.01); *F02M 2200/46* (2013.01); *F02M 2200/703* (2013.01)

(58) Field of Classification Search

CPC .. F02M 51/06; F02M 41/16; F02M 2200/505; F02M 2200/502; F02M 61/1806; F02M 45/086; F02M 47/02

USPC ..... 239/5, 533.11, 96, 584, 533.4, 533.1, 1, 239/533.3, 533.5, 533.12, 102.2, 585.1; 123/457

See application file for complete search history.

(56) References Cited

U.S. PATENT DOCUMENTS 3,100,084 A 8/1963 Biber
4,182,492 A * 1/1980 Albert ..... F02M 59/105 239/92
4,407,457 A * 10/1983 Seifert ..... F02M 45/086 239/533.12
5,211,340 A * 5/1993 Yoshizu ..... F02M 45/08 239/443
5,329,908 A * 7/1994 Tarr ..... F02M 21/0254 123/472
5,463,996 A * 11/1995 Maley ..... F02G 5/00 123/446
5,619,969 A 4/1997 Liu et al.
5,732,679 A 3/1998 Takahasi et al.
5,899,389 A * 5/1999 Pataki ..... F02M 45/086 239/533.2

(Continued)

FOREIGN PATENT DOCUMENTS

DE 1939440 A2 * 7/2008 ..... F02M 45/086
WO 2006/018439 A1 2/2006
WO 2009/055315 A2 4/2009

OTHER PUBLICATIONS

International Search Report and Written Opinion, International Application No. PCT/US2014/038972, dated Oct. 9, 2014, 12 pgs.

*Primary Examiner* — Ryan Reis
*Assistant Examiner* — Joseph A Greenlund
(74) *Attorney, Agent, or Firm* — Faegre Baker Daniels LLP

(57) ABSTRACT

The disclosure provides an improved fuel injector and method of operating the fuel injector to provide at least two different types of fuel spray to a combustion chamber of an internal combustion engine. The two types of spray are formed by providing a first fuel pressure to the fuel injector during a first portion of an injection event at a first pressure and providing a second fuel pressure to the fuel injection (Continued)

during a second portion of the injection event, and maintaining a substantially constant fuel flow rate throughout the injection event.

25 Claims, 6 Drawing Sheets

(56) References Cited

U.S. PATENT DOCUMENTS 5,983,863 A 11/1999 Cavanagh et al.
6,199,533 B1 3/2001 Morris et al.
6,378,503 B1 * 4/2002 Lambert ..... F02M 45/086 123/468
6,471,142 B1 * 10/2002 Lambert ..... F02M 45/08 239/88
6,557,776 B2 * 5/2003 Carroll, III ..... F02M 45/086 239/124
6,557,779 B2 * 5/2003 Perr ..... F02M 45/04 123/468
6,637,675 B2 * 10/2003 Carroll, III ..... F02M 45/086 239/124
6,705,543 B2 * 3/2004 Carroll, III ..... F02M 45/04 239/124
6,769,635 B2 * 8/2004 Stewart ..... F02M 45/02 123/299
6,901,915 B2 * 6/2005 Winter ..... F02M 45/086 123/467
7,143,964 B2 * 12/2006 Kuegler ..... F02M 45/086 123/467
7,159,799 B2 * 1/2007 Cooke ..... F02M 45/086 239/102.2
7,219,655 B2 * 5/2007 Shinogle ..... F02M 45/04 123/456
7,334,741 B2 * 2/2008 Benson ..... F02M 45/083 123/496
7,404,526 B2 * 7/2008 Cooke ..... F02M 45/086 239/102.2
7,588,012 B2 * 9/2009 Gibson ..... F02M 45/02 123/304
7,744,017 B2 * 6/2010 Cooke ..... F02M 45/086 239/102.2
7,789,069 B2 * 9/2010 Rodriguez-Amaya F02M 47/027 123/446
7,891,579 B2 * 2/2011 Mashida ..... F02D 19/10 239/533.11
7,934,668 B2 * 5/2011 Cooke ..... F02D 19/0694 239/102.2
8,201,543 B2 6/2012 Morris et al.
8,210,454 B2 7/2012 Frasch et al.
8,496,191 B2 * 7/2013 Grant ..... F02M 45/086 239/423
2003/0038185 A1 * 2/2003 Carrol, III ..... F02M 45/04 239/96
2003/0052203 A1 * 3/2003 Arndt ..... F02M 45/083 239/585.5
2009/0229630 A1 * 9/2009 Porter ..... B60S 1/485 134/6
2010/0012092 A1 * 1/2010 Futonagane ..... F02M 45/086 123/457
2010/0133361 A1 * 6/2010 Futonagane ..... F02M 45/086 239/533.12
2010/0170475 A1 * 7/2010 Okumura ..... F02M 45/086 123/445
2013/0299609 A1 * 11/2013 Perras ..... F02M 61/18 239/584

* cited by examiner

SYSTEM AND METHOD FOR CONTROL OF FUEL INJECTOR SPRAY

TECHNICAL FIELD

This disclosure relates to a fuel injector that delivers fuel at different pressures and a constant fuel flow rate to a combustion chamber.

BACKGROUND

A variety of techniques exist to control fuel flow into a combustion chamber of an internal combustion engine. These techniques are often described as rate-shaping techniques, which provide varying methods of controlling rates of fuel flow into a combustion chamber. By reducing the rate of fuel flow during an initial portion of an injection event, $NO_x$ formation is reduced. The fuel flow rate is then increased or unrestricted during the latter portion of the injection event. However, dividing an injection event into a first portion with a first fuel flow rate and a second portion with a higher fuel flow rate increases the total length of an injection event, which increases fuel consumption and decreases engine efficiency.

SUMMARY

This disclosure provides a fuel system for injecting fuel into a combustion chamber of an internal combustion engine. The fuel system comprises a variable pressure fuel supply, a fuel injector, and a controller. The variable pressure fuel supply is configured to selectively supply fuel at different pressure levels. The fuel injector includes an injector body, a first needle valve element, a second needle valve element, and an actuator. The injector body contains an injector cavity and a plurality of injector orifices communicating with a first end of the injector cavity to discharge fuel into the combustion chamber. The plurality of injector orifices includes a first set of injector orifices and a second set of injector orifices. The injector body includes a fuel transfer circuit for transferring fuel to the plurality of injector orifices. The first needle valve element is positioned in the injector cavity for controlling fuel flow through the first set of injector orifices and a first valve seat formed on the injector body. The first needle valve element is movable from a closed position against the first valve seat blocking flow through the first set of injector orifices to an open position permitting flow through the first set of injector orifices. The second needle valve element is positioned in the injector cavity for controlling fuel flow through the second set of injector orifices and a second valve seat formed on the injector body. The second needle valve element is movable from a closed position against the second valve seat blocking flow through the second set of injector orifices to an open position permitting flow through the second set of injector orifices. The actuator is movable to permit movement of the first and the second needle valve elements between the open and closed positions to define an injection event. The controller is connected to the actuator and to the variable pressure fuel supply. The controller is configured to generate a control signal to cause the variable pressure fuel supply to supply fuel to the injector cavity at a first pressure level during an initial portion of the injection event and at a second pressure level, higher than the first pressure level, during a subsequent portion of the injection event occurring after the initial portion.

This disclosure also provides a fuel system for injecting fuel into a combustion chamber of an internal combustion engine. The fuel system comprises a variable pressure fuel supply and a fuel injector. The variable pressure fuel supply is configured to selectively supply fuel at a first pressure level and a second pressure level higher than the first pressure level. The fuel injector includes an injector body, a first needle valve element, and a second needle valve element. The injector body contains an injector cavity and a plurality of injector orifices communicating with a first end of the injector cavity to discharge fuel into the combustion chamber. The plurality of injector orifices includes a first set of injector orifices and a second set of injector orifices. The injector body includes a fuel transfer circuit for transferring fuel to the plurality of injector orifices. The first needle valve element is positioned in the injector cavity for controlling fuel flow through the first set of injector orifices and a first valve seat formed on the injector body. The first needle valve element is movable from a closed position against the first valve seat blocking flow through the first set of injector orifices to an open position permitting flow through the first set of injector orifices. The second needle valve element is positioned in the injector cavity for controlling fuel flow through the second set of injector orifices and a second valve seat formed on the injector body. The second needle valve element is movable from a closed position against the second valve seat blocking flow through the second set of injector orifices to an open position permitting flow through the second set of injector orifices. The first and the second set of injector orifices are sized to provide a fuel flow rate at the first pressure level and the second set of injector orifices sized to provide substantially the fuel flow rate at the second pressure level.

This disclosure also provides a method of providing fuel to a combustion chamber from a fuel injector of an internal combustion engine. The method comprises providing fuel at a first fuel pressure level and a fuel flow rate through a first set of injector orifices and a second set of injector orifices into the combustion chamber during a first portion of an injection event, and providing fuel at a second fuel pressure level higher than the first fuel pressure level through the second set of injector orifices to cause fuel flow into the combustion chamber at substantially the same fuel flow rate during a second portion of the injection event.

Advantages and features of the embodiments of this disclosure will become more apparent from the following detailed description of exemplary embodiments when viewed in conjunction with the accompanying drawings.

DETAILED DESCRIPTION

Figure 1:
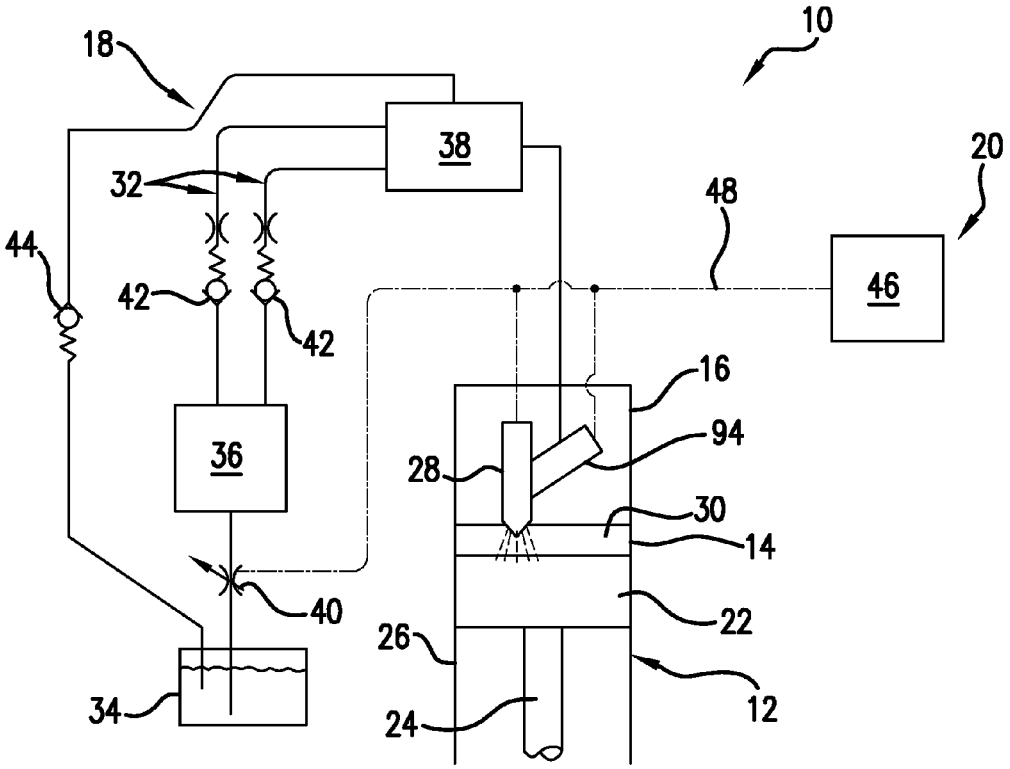
FIG. 1 is a schematic of an internal combustion engine in accordance with a first exemplary embodiment of the present disclosure.

Referring to FIG. 1, a portion of an internal combustion engine in accordance with a first exemplary embodiment of the present disclosure is shown as a simplified schematic and generally indicated at 10. Engine 10 includes an engine body 12, which includes an engine block 14 and a cylinder head 16 attached to engine block 14, a fuel system 18, and a control system 20. While engine 10 works well for its intended purpose, one challenge that continues to face engine designs is the need to cost-effectively increase the efficiency of engine 10. The present disclosure provides an improved fuel injector and method of operating the fuel injector to provide at least two different types of fuel spray in the combustion chambers of engine 10. A first type of spray includes larger droplets that reduce the effective diffusion combustion area around the droplets, which slows the rate of combustion while maintaining a substantially constant fuel injection rate. A second type of spray includes relatively small droplets that increase the effective diffusion combustion area around the droplets. The larger droplets reduce $NO_x$ formation while maintaining a high rate of combustion. The smaller droplets function to burn particulate matter, but due to reduced oxygen and the presence of combustion products such as $CO_2$ formed during combustion of the larger droplets, $NO_x$ production is minimized. The reduction in $NO_x$ is possible while improving fuel efficiency as compared to rate-shaping techniques because in rate-shaping techniques the fuel flow rate is increased with increases in pressure, and in contrast the present disclosure provides for a system and method that maintain the fuel flow rate from the beginning to the end of an injection event, which enables maintaining a length of injection similar to a conventional, non-rate shaped fuel injector. Examples of rate-shaping systems and methods are described in U.S. Pat. Nos. 5,619,969, 5,983,863, 6,199,533, and 7,334,741.

Engine body 12 includes at least one piston 22, and a connecting rod 24. Piston 22 is positioned for reciprocal movement in an engine cylinder 26. Connecting rod 24 connects piston 22 to a crank shaft (not shown). The movement of piston 22 under the action of a combustion process in engine 10 causes connecting rod(s) 24 to move the crankshaft. At least one fuel injector 28 is positioned within cylinder head 16. Each fuel injector 28 is fluidly connected to a combustion chamber 30, each of which is formed by one piston 22, cylinder head 16, and the portion of engine cylinder 26 that extends between piston 22 and cylinder head 16. While FIG. 1 shows one piston 22, one connecting rod 24, one fuel injector 28, and one combustion chamber 30, it will be understood that the exemplary embodiments are applicable to arrangements with a plurality of pistons, connecting rods, fuel injectors, and combustion chambers. Throughout this specification, inwardly, distal, and near are longitudinally in the direction of combustion chamber 30. Outwardly, proximate, and far are longitudinally away from the direction of combustion chamber 30.

Fuel system 18 provides fuel to injector(s) 28, which is then injected into combustion chamber(s) 30 by the action of fuel injector(s) 28, forming one or more injection events. Fuel system 18 includes a fuel circuit 32, a fuel tank 34, which contains a fuel, a fuel pump 36 positioned along fuel circuit 32 downstream from fuel tank 34, and a fuel accumulator or rail 38 positioned along fuel circuit 32 downstream from fuel pump 36. While fuel accumulator or rail 38 is shown as a single unit or element, accumulator 38 may be distributed over a plurality of elements that transmit or receive high-pressure fuel, such as fuel injector(s) 28, fuel pump 36, and any lines, passages, tubes, hoses and the like that connect high-pressure fuel to the plurality of elements. Fuel system 18 may further include an inlet metering valve 40 positioned along fuel circuit 32 upstream from fuel pump 36 and one or more outlet check valves 42 positioned along fuel circuit 32 downstream from fuel pump 36 to permit one-way fuel flow from fuel pump 36 to fuel accumulator 38. A pressure relief valve 44 may also be positioned along fuel circuit 32 to limit the fuel pressure in fuel circuit 32. Though not shown, additional elements may be positioned along fuel circuit 32. For example, inlet check valves may be positioned downstream from inlet metering valve 40 and upstream from fuel pump 36, or inlet check valves may be incorporated in fuel pump 36. A low-pressure fuel pump may also be positioned upstream from fuel pump 36, which may be described as a high-pressure fuel pump, to provide low-pressure fuel to fuel pump 36 to increase the efficiency of fuel pump 36. Inlet metering valve 40 has the ability to vary or shut off fuel flow to fuel pump 36, which thus varies or shuts off fuel flow to fuel accumulator 38. Fuel circuit 32 connects fuel accumulator 38 to fuel injector(s) 28, which then provide controlled amounts of fuel to combustion chamber(s) 30.

Control system 20 may include a controller, i.e., a control module, 46 and a wire harness 48. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions (software), such as logical blocks, program modules etc. being executed by one or more processors (e.g., one or more microprocessor, a central processing unit (CPU), and/or application specific integrated circuit), or by a combination of both. For example, embodiments can be implemented in hardware, software, firmware, middleware, microcode, or any combination thereof. The instructions can be program code or code segments that perform necessary tasks and can be stored in a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control module 46 may be an electronic control unit or electronic control module (ECM) that may monitor conditions of engine 10 or an associated vehicle in which engine 10 may be located. Control module 46 may be a single processor, a distributed processor, an electronic equivalent of a processor, or any combination of the aforementioned elements, as well as software, electronic storage, fixed lookup tables and the like. Control module 46 may include a digital or analog circuit. Controller 46 may connect to certain components of engine 10 by wire harness 48, though such connection may be by other means, including a wireless system. For example, controller 46 may connect to, generate, and provide control signals to inlet metering valve 40, to fuel injector(s) 28, and to a variable pressure fuel supply.

When engine 10 is operating, combustion in combustion chambers 30 causes the movement of piston(s) 22. The movement of piston(s) 22 causes movement of connecting rod(s) 24, which are drivingly connected to a crankshaft (not shown), and movement of connecting rod(s) 24 causes rotary movement of the crankshaft. The angle of rotation of the crankshaft is measured by engine 10 to aid in timing of combustion events in engine 10 and for other purposes. The angle of rotation of the crankshaft may be measured in a plurality of locations, including a main crank pulley (not shown), an engine flywheel (not shown), an engine camshaft (not shown), or on the camshaft itself.

The action of the crankshaft drives fuel pump 36, which pulls fuel from fuel tank 34 and moves the fuel along fuel circuit 32 toward inlet metering valve 40. From inlet metering valve 40, fuel flows downstream along fuel circuit 32 through inlet check valves (not shown) to fuel pump 36. Fuel pump 36 moves the fuel downstream along fuel circuit 32 through outlet check valves 42 toward fuel accumulator or rail 38. Inlet metering valve 40 receives control signals from control system 20 and is operable to control or block fuel flow to fuel pump 36. Inlet metering valve 40 may be a proportional valve or may be an on-off valve that is capable of being rapidly modulated between an open and a closed position to adjust the amount of fuel flowing through the valve. Pressure relief valve 44 connects a high-pressure portion of fuel circuit 42 to fuel tank 34, and limits the pressure in the high-pressure portion of fuel circuit 42. Controller 46 determines the timing of injection events in fuel injector 28, along with the duration of such events, to control the combustion process in combustion chambers 30.

Referring to FIGS. 2-5, fuel injector 28 includes an injector body 50, a needle valve assembly 52, an actuator 54, and a longitudinal axis 68. In an exemplary embodiment, actuator 54 includes a direct-acting piezoelectric device that permits controlling the movement of needle valve assembly 52 as described hereinbelow. A direct-acting piezoelectric device with a hydraulic link, such as the piezoelectric device similar to that disclosed in U.S. Pat. No. 8,201,543, incorporated herein by reference in its entirety, may be used as actuator 54. While the exemplary embodiment includes a direct-acting piezoelectric device, other actuator arrangements that meet the control requirements described hereinbelow may be used as actuator 54, such as the solenoid actuators shown in U.S. Pat. Nos. 6,557,776 and 6,557,779, incorporated herein by reference in their entirety.

Injector body 50 includes an injector cavity 56 and a plurality of injector orifices 58 communicating with a distal or first end 60 of injector cavity 56 to permit discharge of fuel from injector cavity 56 into combustion chamber 30. Injector body 50 further includes a fuel transfer circuit 69. Injector orifices 58 includes a first set of injector orifices 70 located at a first radial distance 72 from longitudinal axis 68 and a second set of injector orifices 74 located at a second radial distance 76 from longitudinal axis 68. A first valve seat 82 is formed on an interior portion of injector body 50 in a location between first radial distance 72 and second radial distance 76. A second valve seat 84 is formed on an interior portion of injector body 50 in a location that is at a third radial distance 77 that is greater than second radial distance 76. Injector body 50 may also include an injector barrel 62, a nozzle housing 64, and a coupler 66 for attaching nozzle housing 64 to injector barrel 62. Injector barrel 62 includes an inlet passage 71 for connecting fuel from the variable pressure fuel supply to injector cavity 56. Needle valve assembly 52 includes a first needle valve element 78 positioned in injector cavity 56 for controlling fuel flow through first set of injector orifices 70 and a second needle valve element 80 positioned in injector cavity 56 for controlling fuel flow through second set of injector orifices 74. First needle valve element 78 is movable along longitudinal axis 68 from a closed position against first valve seat 82, which blocks fuel flow through first set of injector orifices 70, to an open position that permits fuel flow through first set of injector orifices 70. Second needle valve element 80 is movable along longitudinal axis 68 from a closed position against second valve seat 84, which blocks fuel flow through second set of injector orifices 74, to an open position that permits fuel flow through second set of injector orifices 74.

First needle valve element 78 includes a first needle distal end 97 that is adapted or configured to contact first valve seat 82 to block fuel flow to first set of injector orifices 70. First needle valve element 78 also includes a radially extending portion 99. Second needle valve element 80 includes a needle element cavity 86, formed by an interior surface 87, a transverse interior surface 93, a needle stop 88, and one or more needle passages 73. Needle stop 88 is fixedly formed on or attached to second needle valve element 80, such as by press fitting, in needle element cavity 86. Needle stop 88 includes a terminal or distal end portion 89, a proximate end surface 95, and a stop cavity 91. Needle stop 88 further includes one or more radially extending stop passages 90 that connect stop cavity 91 to the exterior of needle stop 88 to permit fuel flow in and out of stop cavity 91. First needle valve element 78 is telescopically received in needle element cavity 86 and stop cavity 91 to be slidably movable with respect to interior surface 87 along longitudinal axis 68. Fuel injector 28 further includes a first bias spring 100 positioned in stop cavity 91 between proximate end surface 95 and radially extending portion 99. In the exemplary embodiment, first bias spring 100 is in abutment with proximate end surface 95 and with radially extending portion 99 of first needle valve element 78. Radially extending portion 99 of first needle valve element 78 includes a first needle shoulder 96 on a distal side of radially extending portion 99. First bias spring 100 functions to bias or move first needle valve element 78 toward the distal end of fuel injector 28. When first needle valve element 78 is able to contact first valve seat 82 because of the position of second needle valve element 80, first bias spring 100 provides a bias force on first needle valve element 78 to be in a closed position in contact with first valve seat 82.

Fuel injector 28 further includes a plunger assembly 92, which movably connects actuator 54 with second needle valve element 80. In the exemplary embodiment, plunger assembly 92 includes a plunger bias spring 102, a plunger adapter 104, a first plunger 106, a hydraulic link 108, which includes a hydraulic link housing 110, and a second plunger 112. Hydraulic link housing 110 abuts injector barrel 62 and nozzle housing 64, preventing movement of hydraulic link housing 110. Hydraulic link housing 110 further includes a first longitudinal passage 120 and a second longitudinal passage 122. Plunger adapter 104 is configured to provide an interface between actuator 54 and first plunger 106. First plunger 106 extends along longitudinal axis 68 and slidably extends into first longitudinal passage 120 of hydraulic link housing 110 at a first, proximate end 116 in a substantially sealing manner that limits fluid flow along a first radial interface 114 between first plunger 106 and hydraulic link housing 110. Second plunger 112 extends along longitudinal axis 68 and slidably extends into second longitudinal passage 122 of hydraulic link housing 110 at a second, distal end 118 in a substantially sealing manner that limits fluid flow along a second radial interface 124 between second plunger 112 and hydraulic link housing 110. Second plunger 112 extends into and fixedly engages second needle valve element 80 so that movement of second plunger 112 causes movement of second needle valve element 80. Plunger bias spring 102 is positioned longitudinally between second needle valve element 80 and hydraulic link housing 110 and serves to assist in the movement of second needle valve element 80 into the closed position in conjunction with the movement of actuator 54.

Fuel transfer circuit 69 includes injector cavity 56 and inlet passage 71. As described further hereinbelow, during an injection event, fuel transfer circuit 69 transports or transfers fuel from fuel system 18 to first set of injection orifices 70 and second set of injector orifices 74. More specifically, inlet passage 71 accepts fuel at a plurality of pressure levels and transfers the fuel to injector cavity 56. The fuel flows along injector cavity 56 to the distal end of fuel injector 28. When controller 46 generates and transmits a control signal to de-energize actuator 54 to move second needle valve element 80 outwardly, first needle valve element 78 initially remains stationary with respect to nozzle housing 64 because of the force from bias spring 100. As second needle valve element 80 moves further outward, first needle shoulder 96 of first needle valve element 78 contacts transverse interior surface 93 of second needle valve element 80, which causes first needle valve element 78 to move with second needle valve element 80. Because actuator 54 moves at a high rate of speed, the movement of second needle valve element 80 and first needle valve element 78 from second valve seat 84 and first valve seat 82, respectively, at the beginning of an injection event is nearly instantaneous. Once first needle valve element 78 and second needle valve element 80 have moved away from first valve seat 82 and second valve seat 84, fuel is able to flow from fuel transfer circuit 69 through one or more sets of fuel injector orifices into combustion chamber 30.

Engine 10 further includes a variable pressure fuel supply 94 configured to selectively supply fuel at different pressure levels to fuel transfer circuit 69 of fuel injector 28. In the exemplary embodiment, variable pressure fuel supply 94 provides fuel to fuel transfer circuit 69 at two pressure levels. In the embodiment of FIGS. 1-5, variable pressure fuel supply 94 is a fuel pressure amplifier that may be similar to the fuel pressure amplifier of U.S. Pat. No. 7,789,069, which is hereby incorporated by reference in its entirety, and which is mounted on or attached to fuel injector 28.

Figure 2:
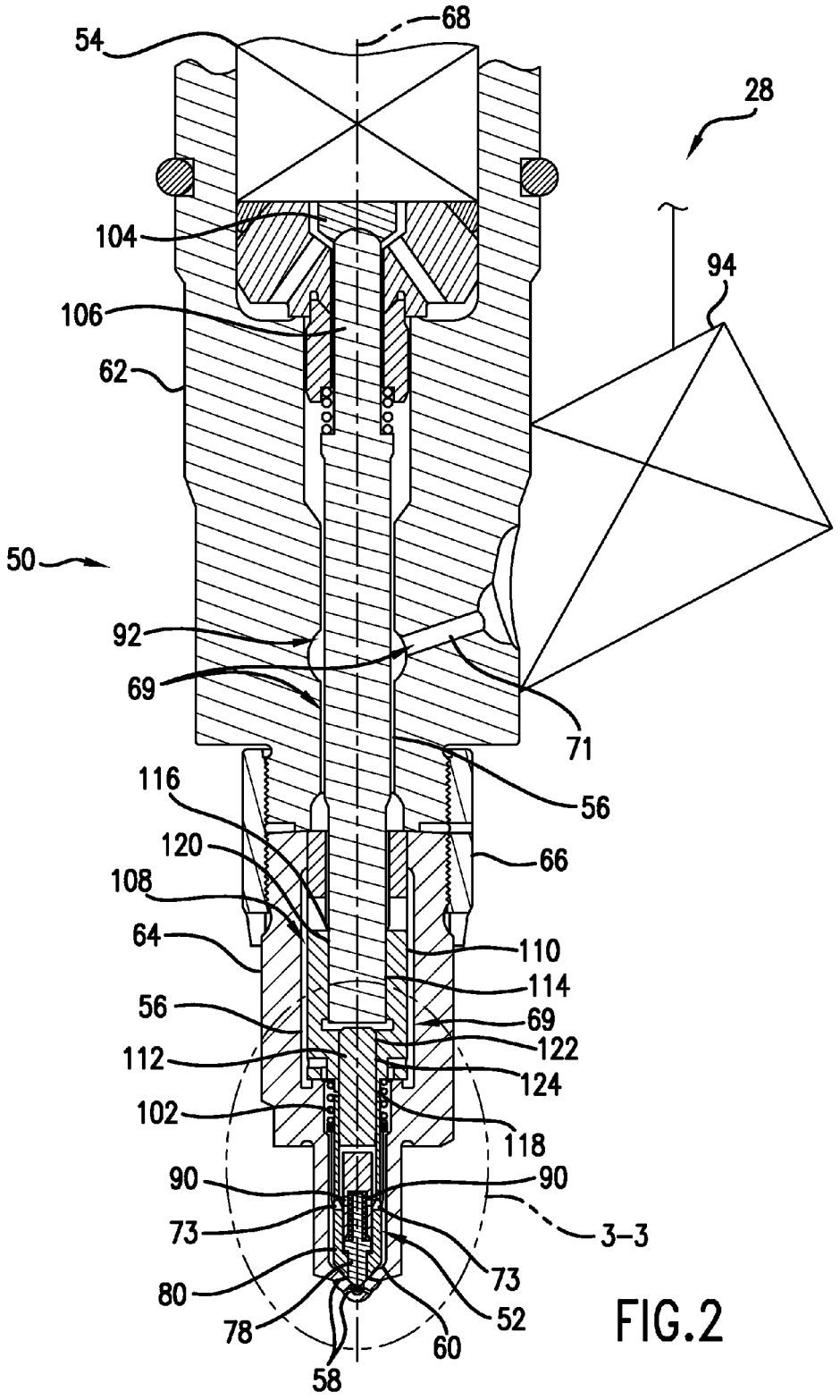
FIG. 2 is a sectional view of a fuel injector of the engine of FIG. 1 in accordance with an exemplary embodiment of the present disclosure.
Figure 3:
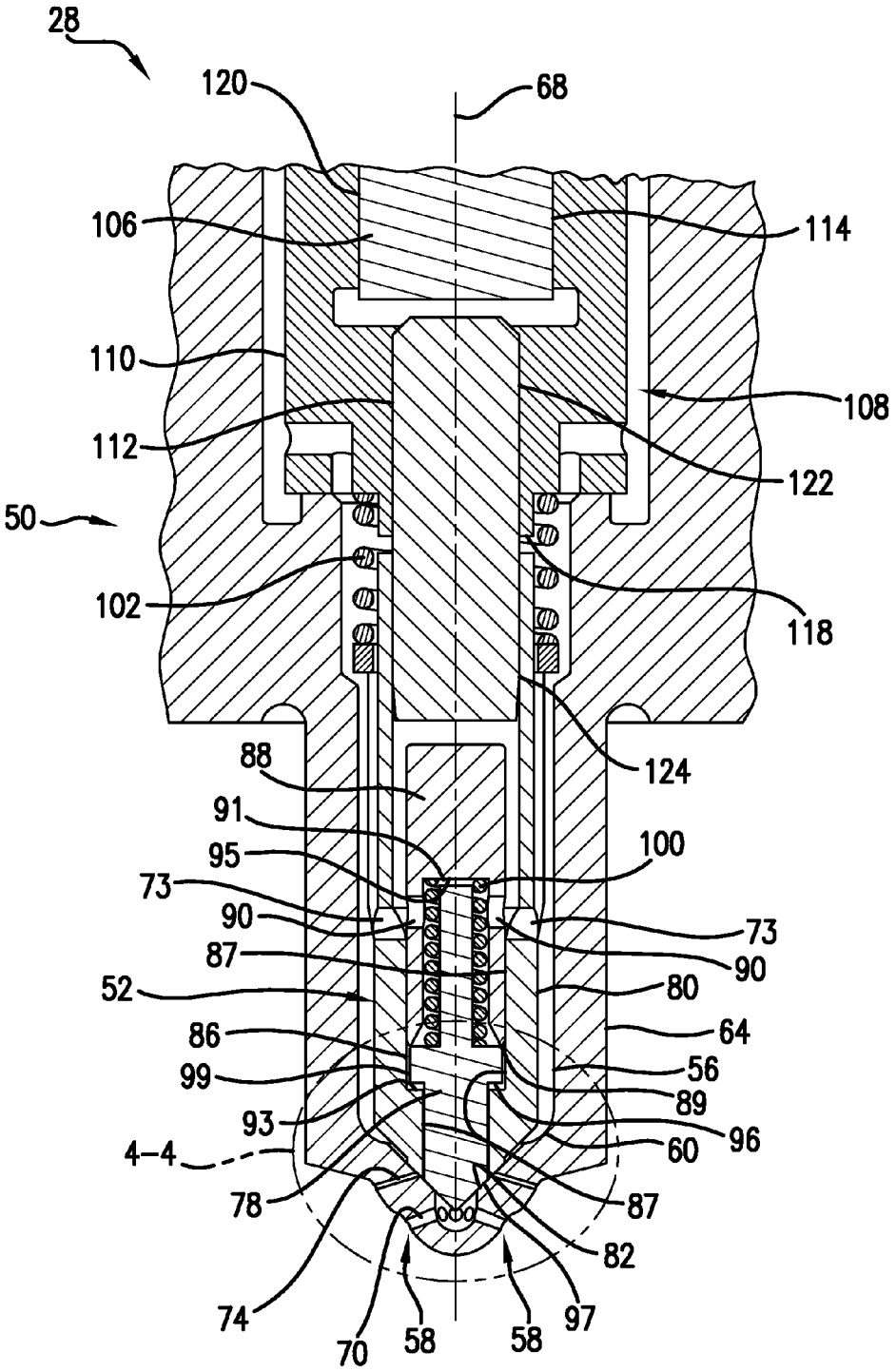
FIG. 3 is a view of a portion of the fuel injector of FIG. 2 along the lines 3-3 with a first and needle valve element in a closed position.
Figure 4:
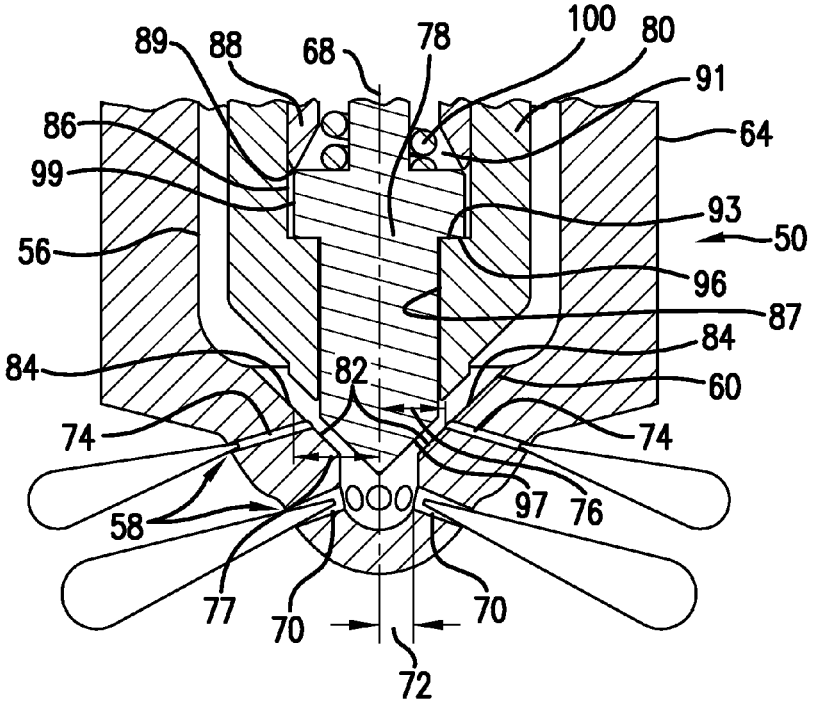
FIG. 4 is a view of a portion of the fuel injector of FIG. 3 along the lines 4-4 with the first and second needle valve element in an open position.
Figure 5:
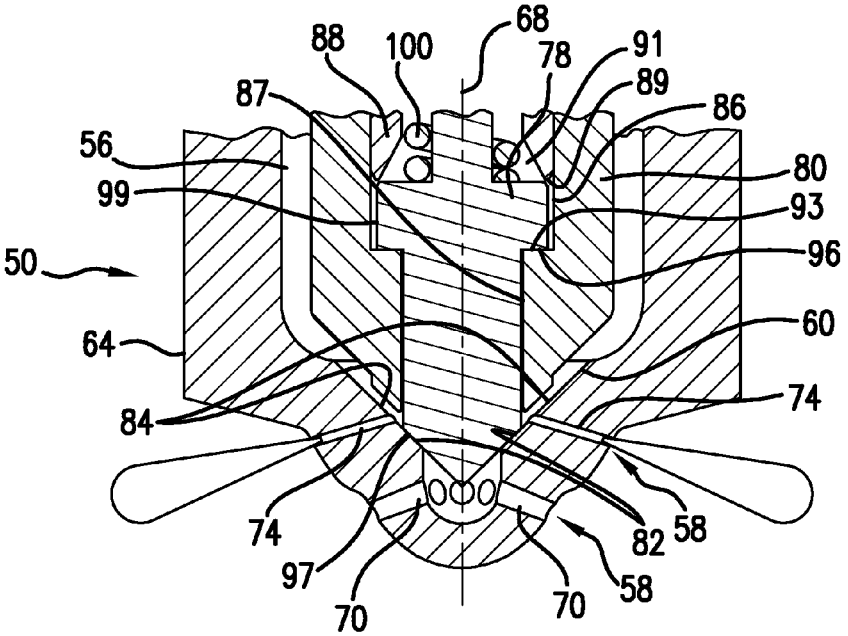
FIG. 5 is a view of a portion of the fuel injector of FIG. 4 with the second needle valve element in the open position and the first needle valve element in the closed position.

The operation of fuel injector 28 and engine 10 centers on a fuel injection event, which occurs from the time at least one needle valve element moves from first valve seat 82 or second valve seat 84 to permit fuel flow from fuel transfer circuit 69 through one or more sets of injector orifices into combustion chamber 30 until a subsequent time when both needle valve elements are positioned in contact with first valve seat 82 and second valve seat 84 to stop fuel flow from fuel transfer circuit 69 through all injector orifices into combustion chamber 30. When controller 46 determines it is time for an injection event, at time $T_1$ shown in FIGS. 6 and 7, controller 46 generates and transmits a signal to actuator 54 of fuel injector 28 to de-energize actuator 54. In the exemplary embodiment, actuator 54 is a piezoelectric stack that contracts when de-energized. The fuel pressure at the proximate end of plunger assembly 92, more specifically, at the proximate end of first plunger 106, is at drain pressure. The pressure at the distal end of second needle valve element 80 is at the pressure of fuel system 18, which is substantially higher than drain pressure, which is near atmospheric pressure. When the force from actuator 54 on the proximate end of plunger assembly 92 drops, the pressure in hydraulic link 108 drops accordingly, which permits fuel pressure on the distal end of second needle valve element 80 to move second needle valve element 80 longitudinally toward the proximate end of fuel injector 28. The movement of second needle valve element 80 moves second plunger 112 since second plunger 112 is fixedly attached to second needle valve element 80. The movement of second needle valve element 80 compresses plunger bias spring 102. As previously described, the movement of second needle valve element 80 causes longitudinal movement of first needle valve element 78, and thus second needle valve element 80 and first needle valve element 78 move away from second valve seat 84 and first valve seat 82, respectively, which begins the injection event. Once second needle valve element 80 lifts first needle valve element 78 from first valve seat 82, first needle valve element 78 extends from second needle valve element 80 in a manner or configuration that may be described as telescoping. First needle valve element 78 is able to move freely by the exchange of fuel between needle element cavity 86 and injector cavity 56 through stop passages 90 and a plurality of corresponding needle passages 73 formed in second needle valve element 80. The longitudinal movement of first needle valve element 78 and second needle valve element 80 from first valve seat 82 and second valve seat 84, as shown in FIG. 2, permits fuel to flow through first set of injector orifices 70 and second set of injector orifices 74, signifying the beginning of an injection event.

Figure 6:
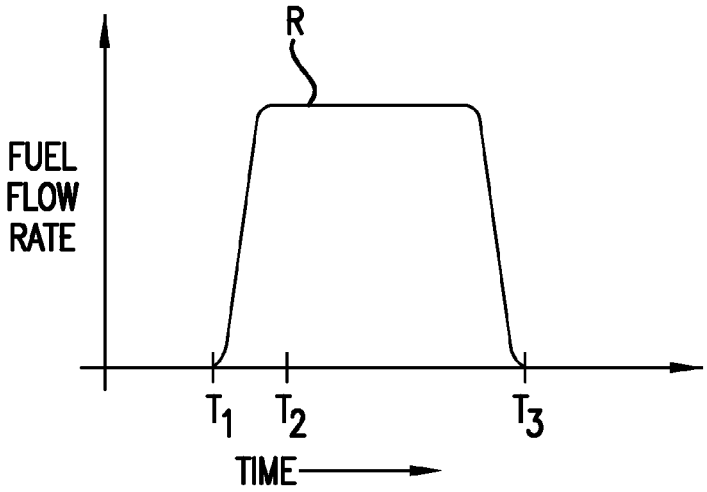
FIG. 6 is a graph of a fuel flow rate through the fuel injector of FIG. 2 during an injection event.
Figure 7:
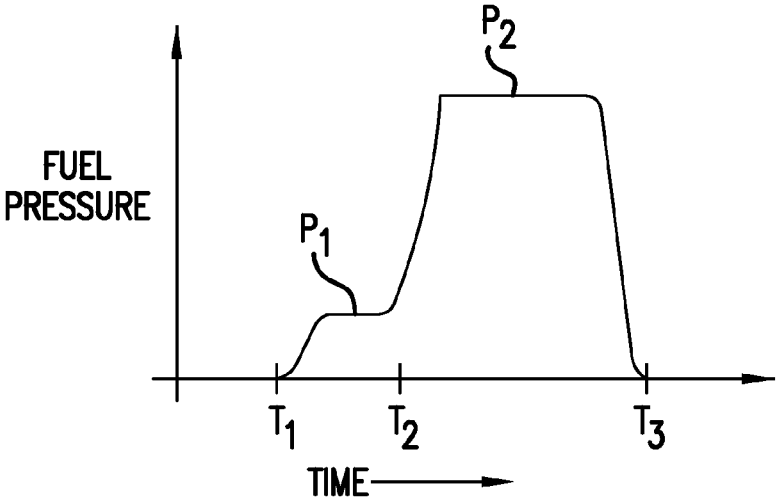
FIG. 7 is a graph of a pressure into the fuel injector of FIG. 2 during an injection event.

Fuel is always present in fuel transfer circuit 69 at fuel pressure P1, and after time $T_1$ the fuel flows through first set of injector orifices 70 and second set of injector orifices 74 at a rate R, as shown in FIG. 6. At a time $T_2$, controller 46 generates and transmits a control signal to command or energize actuator 54 to move plunger assembly 92 longitudinally toward the distal end of fuel injector 28, causing first plunger 106 to impart a force on second needle valve element 80 via hydraulic link 108, which, along with the force from plunger bias spring 102, moves needle valve element 80 towards a closed position. However, the movement of second nozzle valve element 80 is limited, but of sufficient magnitude so that second nozzle valve element 80 remains in an open position while an edge or portion of first nozzle valve element 78 moves to contact first valve seat 82, stopping fuel flow through first set of injector orifices 70. Bias spring 100 may compress a small amount to assist in maintaining contact between first needle valve element 78 and first valve seat 82. At approximately the same time that controller 46 is moving second needle valve element 80 an amount sufficient to cause first needle valve element 78 to contact first valve seat 82, controller 46 generates and transmits a control signal to variable pressure fuel supply 94 to increase fuel pressure to injector cavity 56 of fuel injector 28 to $P_2$. The closing of first set of injector orifices 70 would decrease the flow of fuel into combustion chamber 30, but the increase in fuel pressure to fuel injector 28 offsets the fuel flow rate decrease such that the fuel flow rate into combustion chamber 30 remains constant after time $T_2$, as can be seen in FIGS. 6 and 7. First set of injector orifices 70 and second set of injector orifices 74 are selected, sized, and dimensioned to maintain a substantially constant fuel flow rate throughout the injection event, which ends when controller 46 generates a command to actuator 54 to move plunger assembly 92. In the context of this disclosure, a substantially constant fuel flow rate means to obtain as close to a constant fuel flow rate throughout the injection event as possible, with variations during the short transitions of first needle valve element 78 and second needle valve 80 between open and closed positions, which includes transition from the closed position and transition to the closed position. In the exemplary embodiment, the piezoelectric elements of actuator 54 expand, moving plunger adapter 104 and first plunger 106, which causes the movement of second plunger 112 through hydraulic link 108. Because second plunger 112 is attached to second needle valve element 80, the movement of second plunger 112 causes second needle valve element 80 to move longitudinally to contact second valve seat 84, assisted by plunger bias spring 102, which stops fuel flow through second set of injector orifices 74, ending the injection event at time $T_3$. As can be readily seen from FIG. 7, fuel pressure supplied to fuel injector 28 remains at $P_2$ for substantially the entire period or interval from $T_2$ to $T_3$, which corresponds to first needle valve element 78 being in the closed position and second needle valve element 80 being in the open position. In an exemplary embodiment, second set of injector orifices 74 have a cross-sectional flow area of that is one-half the total cross sectional flow area of second set of injector orifices 74 and first set of injector orifices 70 and $P_2$ is four times $P_1$, which may be determined from conventional calculations of fuel flow rate through orifices. In an exemplary embodiment, the interval from time $T_1$ to time $T_2$, which is a first portion of the injection event, is approximately 25% to 50% of the total time interval from $T_1$ to $T_3$. The interval from $T_2$ to $T_3$ is a second portion of the injection event.

The fuel flow rate R at pressure $P_1$ provides relatively large fuel droplets in combustion chamber 30 that reduce the effective diffusion combustion area around the fuel droplets. The large fuel droplets reduce $NO_x$ formation while maintaining a high rate of combustion. The fuel flow rate R at pressure $P_2$ forms relatively small fuel droplets that increase the effective diffusion combustion area around the fuel droplets. The smaller fuel droplets function to burn particulate matter, but due to reduced oxygen and the presence of combustion products such as $CO_2$ formed during combustion of the larger droplets, $NO_x$ production is minimized. As described hereinabove, the benefit to varying the pressure while maintaining a constant fuel flow rate is that the width of the fuel injection event is the same as for a fuel injector without rate shaping while attaining benefits similar to a rate-shaping fuel injector.

Figure 8:
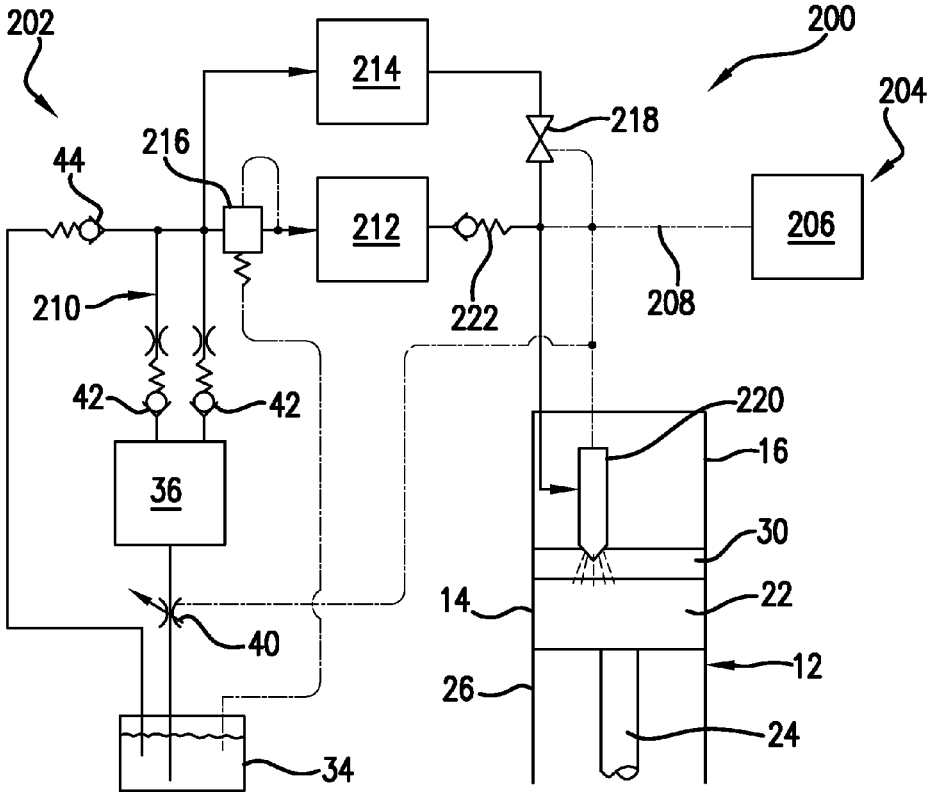
FIG. 8 is a schematic of an internal combustion engine in accordance with a second exemplary embodiment of the present disclosure.

It should be understood from the foregoing description that variable pressure fuel supply 94 may take many different forms, as long as variable pressure fuel supply 94 is configured to receive control signals from control system 20 and to provide the pressure levels needed to maintain the constant fuel flow rate into combustion chamber 30 shown in FIGS. 6 and 7. For example, in a second exemplary embodiment of the present disclosure, shown in FIG. 8, where item numbers having the same number as the first embodiment function as described in the first embodiment and are described in this embodiment only for the sake of clarity, two pressures may be provided by two fuel rails. An engine 200 includes a fuel system 202, a control system 204, which may be similar to control system 20 previously described, and a fuel injector 220. Control system 204 includes a controller, i.e., a control module, 206, which may be similar to controller or control module 46 previously described, and a wire harness 208, which may be similar to wire harness 48, previously described. Fuel system 202 includes a fuel circuit 210, along which are positioned a first fuel accumulator or rail 212, a second fuel accumulator or rail 214, a pressure reducing valve 216, a control valve 218, and a check valve 222. Pressure reducing valve 216 is positioned between fuel pump 36 and first fuel accumulator 212 to reduce the pressure provided by fuel pump 36 to $P_1$. The fuel pressure in second fuel accumulator 214 will be fuel pressure $P_2$ provided by fuel pump 36, which may be set by pressure relief valve 44. Control valve 218 is positioned downstream from fuel accumulator 214 and upstream from fuel injector 220. During an injection event, fuel injector 220 operates similar to fuel injector 28, with fuel pressure P1 present at fuel injector 220. Controller 206 generates and transmits control signals to control valve 218, which selectively connects pressure $P_2$ from second fuel accumulator 214 to injector 220 during the period or interval from time $T_2$ to time $T_3$ of an injection event, which closes check valve 222 positioned between control valve 218 and first fuel accumulator 212. Once the injection event is over, controller 206 closes control valve 218, which restores pressure P1 to fuel injector 220 in preparation for a subsequent injection event.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel system for injecting fuel into a combustion chamber of an internal combustion engine, the fuel system comprising:

a variable pressure fuel supply configured to selectively supply fuel at different pressure levels;

a fuel injector including, an injector body containing an injector cavity and a plurality of injector orifices communicating with a first end of the injector cavity to discharge fuel into the combustion chamber, the plurality of injector orifices including a first set of injector orifices and a second set of injector orifices, the injector body including a fuel transfer circuit for transferring fuel to the plurality of injector orifices;

a first needle valve element positioned in the injector cavity for controlling fuel flow through the first set of injector orifices and a first valve seat formed on the injector body, the first needle valve element movable from a closed position against the first valve seat blocking flow through the first set of injector orifices to an open position permitting flow through the first set of injector orifices;

a second needle valve element positioned in the injector cavity for controlling fuel flow through the second set of injector orifices and a second valve seat formed on the injector body, the second needle valve element movable from a closed position against the second valve seat blocking flow through the second set of injector orifices to an open position permitting flow through the second set of injector orifices; and an actuator movable to permit movement of the first and the second needle valve elements between the open and closed positions to define an injection event; and a controller connected to the actuator and to the variable pressure fuel supply, the controller configured to generate a control signal to cause the variable pressure fuel supply to supply fuel to the injector cavity at a first pressure level during an initial portion of the injection event and at a second pressure level, higher than the first pressure level, during a subsequent portion of the injection event occurring after the initial portion, wherein the first and the second set of injector orifices are sized to maintain a flow rate of fuel into the combustion chamber at a substantially constant rate during the initial portion of the injection event and the subsequent portion of the injection event.

2. The fuel system of claim 1, wherein fuel is supplied to the injector cavity at the second pressure level when the second needle valve element is in the open position and the first needle valve element is in the closed position.

3. The fuel system of claim 2, wherein fuel is supplied to the injector cavity at the second pressure level for substantially the entire time the second needle valve element is in the open position while the first needle valve element is in the closed position.

4. The fuel system of claim 1, wherein the first needle valve element is telescopingly received within a cavity formed in the second needle valve element to form a sliding fit with an inner surface of the second needle valve element.

5. The fuel system of claim 1, wherein the variable pressure fuel supply includes a fuel pressure amplifier fluidly connected to the injector cavity.

6. The fuel system of claim 5, wherein the fuel pressure amplifier is mounted on the injector body.

7. The fuel system of claim 1, wherein the first and the second set of injector orifices are sized to maintain a flow rate of fuel into the combustion chamber at a substantially constant rate throughout the initial portion of the injection event and the subsequent portion of the injection event.

8. The fuel system of claim 1, wherein the variable pressure fuel supply includes a first fuel accumulator and a second fuel accumulator selectively connected by a valve to the fuel injector.

9. A fuel system for injecting fuel into a combustion chamber of an internal combustion engine, the fuel system comprising:

a variable pressure fuel supply configured to selectively supply fuel at a first pressure level and a second pressure level higher than the first pressure level during an injection event;

a fuel injector including, an injector body containing an injector cavity and a plurality of injector orifices communicating with a first end of the injector cavity to discharge fuel into the combustion chamber, the plurality of injector orifices including a first set of injector orifices and a second set of injector orifices, the injector body including a fuel transfer circuit for transferring fuel to the plurality of injector orifices;

a first needle valve element positioned in the injector cavity for controlling fuel flow through the first set of injector orifices and a first valve seat formed on the injector body, the first needle valve element movable from a closed position against the first valve seat blocking flow through the first set of injector orifices to an open position permitting flow through the first set of injector orifices; and a second needle valve element positioned in the injector cavity for controlling fuel flow through the second set of injector orifices and a second valve seat formed on the injector body, the second needle valve element movable from a closed position against the second valve seat blocking flow through the second set of injector orifices to an open position permitting flow through the second set of injector orifices; and the first and the second set of injector orifices sized to provide a first fuel flow rate in response to the variable pressure fuel supply supplying fuel at the first pressure level, and the second set of injector orifices sized to provide a second fuel flow rate substantially equal to the first fuel flow rate in response to the variable pressure fuel supply supplying fuel at the second pressure level, when the second needle valve element is in the open position and the first needle valve element is in the closed position.

10. The fuel system of claim 9, wherein the first needle valve element is telescopingly received within a cavity formed in the second needle valve element to form a sliding fit with an inner surface of the second needle valve element.

11. The fuel system of claim 9, wherein the variable pressure fuel supply includes a fuel pressure amplifier fluidly connected to the injector cavity.

12. The fuel system of claim 11, wherein the fuel pressure amplifier is mounted on the injector body.

13. The fuel system of claim 9, wherein the variable pressure fuel supply includes a first fuel accumulator and a second fuel accumulator selectively connected by a valve to the fuel injector.

14. A method of providing fuel to a combustion chamber from a fuel injector of an internal combustion engine, the method comprising:

providing fuel to the fuel injector at a first fuel pressure level and into the combustion chamber at a fuel flow rate through a first set of injector orifices and a second set of injector orifices, during a first portion of an injection event; and providing fuel to the fuel injector at a second fuel pressure level higher than the first fuel pressure level and into the combustion chamber through the second set of injector orifices to cause fuel flow into the combustion chamber at substantially the same fuel flow rate, during a second portion of the injection event.

15. The method of claim 14, the fuel injector comprising a plurality of valve elements, the method further comprising controlling fuel flow through the first set of injector orifices and the second set of injector orifices formed in the fuel injector with the plurality of valve elements.

16. The method of claim 14, further comprising positioning a first needle valve element in an open position with a second needle valve element.

17. The method of claim 16, wherein the first needle valve element is telescopingly positioned within the second needle valve element.

18. The method of claim 14, wherein the source of fuel is a variable pressure fuel supply.

19. The method of claim 18, wherein the variable pressure fuel supply includes a fuel pressure amplifier.

20. The method of claim 14, further comprising selecting, sizing, and dimensioning the first set of injector orifices and the second set of injector orifices to deliver the substantially the same fuel flow rate during the first portion and the second portion of the fueling event, respectively.

21. The method of claim 14, further comprising moving a second needle valve element to open the second set of injector orifices and moving a first needle valve element with the second needle valve element to open the first set of injector orifices.

22. The method of claim 14, further comprising maintaining a substantially constant fuel flow rate into the combustion chamber throughout the injection event.

23. The method of claim 14, further comprising generating a control signal to cause a variable pressure fuel supply to supply the fuel to the fuel injector at one fuel pressure level during the first portion of the injection event and at another fuel pressure level higher than the one fuel pressure level during the second portion of the injection event.

24. The method of claim 14, further comprising substantially preventing fuel flow through the first set of injector orifices during the second portion of the injection event.

25. The fuel system of claim 9, wherein the variable pressure fuel supply is configured to selectively supply the fuel at the first pressure level and the second pressure level to the fuel injector during the injection event.

* * * * *